US009364741B2

(12) United States Patent
Rosenberg

(10) Patent No.: US 9,364,741 B2
(45) **Date of Patent: *Jun. 14, 2016**

(54) TOY PROJECTILE LAUNCHING SYSTEM

(71) Applicant: EyeSpy Toys Ltd, Gibraltar (GI)

(72) Inventor: Benjamin Rosenberg, London (GB)

(73) Assignee: EyeSpy Toys Ltd, Gibraltar (GI)

( * ) Notice: Subject to any disclaimer, the term of this patent is extended or adjusted under 35 U.S.C. 154(b) by 0 days.

This patent is subject to a terminal disclaimer.

(21) Appl. No.: 14/658,165

(22) Filed: Mar. 14, 2015

(65) Prior Publication Data

US 2015/0238851 A1 Aug. 27, 2015

Related U.S. Application Data

(63) Continuation of application No. 14/168,018, filed on Jan. 30, 2014, now Pat. No. 9,004,976.

(60) Provisional application No. 61/896,071, filed on Oct. 27, 2013.

(30) Foreign Application Priority Data

Aug. 1, 2013 (GB) ..... 1313809.4

(51) Int. Cl.

| | |
|---|---|
| ***A63H 17/00*** | (2006.01) |
| ***A63F 9/02*** | (2006.01) |
| ***F41A 33/00*** | (2006.01) |
| *A63F 9/24* | (2006.01) |

(52) U.S. Cl.

CPC ..... *A63F 9/0252* (2013.01); *A63F 9/02* (2013.01); *A63F 9/0204* (2013.01); *A63F 9/0278* (2013.01); *F41A 33/00* (2013.01); *A63F 2009/0286* (2013.01); *A63F 2009/2489* (2013.01)

(58) Field of Classification Search

USPC ..... 446/175, 429, 435, 473; 443/11, 14, 15, 443/16; 434/11, 14, 15, 16

See application file for complete search history.

(56) References Cited

U.S. PATENT DOCUMENTS

| | | | |
|---|---|---|---|
| 3,790,948 | A | 2/1974 | Ratkovich |
| 4,065,753 | A | 12/1977 | Paul |
| 4,630,044 | A | 12/1986 | Polzer |
| 5,246,372 | A | 9/1993 | Campagnuolo et al. |
| 5,334,673 | A | 8/1994 | Wu |
| H1451 | H | 6/1995 | Campagnuolo |

(Continued)

FOREIGN PATENT DOCUMENTS

| | | | |
|---|---|---|---|
| WO | 9948046 | A1 | 9/1999 |
| WO | 2008147820 | A1 | 12/2008 |

OTHER PUBLICATIONS

AEG Aktiengesellschaft, "Electronic Identification Trovan(R)", 8 pages, Apr. 28, 1998.

(Continued)

*Primary Examiner* — Kurt Fernstrom
(74) *Attorney, Agent, or Firm* — Soquel Group LLC

(57) ABSTRACT

A toy projectile launching system including at least one toy projectile, and at least one toy launcher, each including a receptacle into which a projectile is loaded, a launching mechanism for physically launching a projectile after it is loaded into the receptacle, a target area sensitive to being hit by a projectile, and a display for presenting a message when a projectile, launched by another launcher, hits the target area.

8 Claims, 5 Drawing Sheets

(56) References Cited

U.S. PATENT DOCUMENTS

| | | | | |
|---|---|---|---|---|
| 5,447,436 | A | 9/1995 | Campagnuolo et al. | |
| 5,481,979 | A | 1/1996 | Walder | |
| 5,743,815 | A | 4/1998 | Helderman | |
| 5,842,907 | A | 12/1998 | Nimura et al. | |
| 5,904,621 | A * | 5/1999 | Small | F41A 33/02 434/22 |
| 6,071,166 | A * | 6/2000 | Lebensfeld | A63F 9/0291 446/175 |
| 6,254,486 | B1 * | 7/2001 | Mathieu | A63F 9/0291 446/175 |
| 6,604,946 | B2 | 8/2003 | Oakes | |
| 6,764,420 | B2 | 7/2004 | Cyr et al. | |
| 6,851,675 | B1 * | 2/2005 | Jakubec | A63B 65/12 273/355 |
| 6,945,782 | B2 * | 9/2005 | Isoz | F41G 3/2655 434/11 |
| 7,488,231 | B2 | 2/2009 | Weston | |
| D606,598 | S | 12/2009 | Lau | |
| 7,849,627 | B2 | 12/2010 | Wygant | |
| 8,021,239 | B2 | 9/2011 | Weston et al. | |
| 8,075,430 | B1 | 12/2011 | Hester | |
| 8,223,019 | B2 | 7/2012 | August et al. | |
| 8,399,817 | B1 | 3/2013 | Rayms-Keller et al. | |
| 8,469,824 | B1 * | 6/2013 | Farley | F41J 5/02 434/11 |
| 8,632,376 | B2 | 1/2014 | Dooley et al. | |
| 2005/0183708 | A1 | 8/2005 | Eddins et al. | |
| 2005/0231362 | A1 | 10/2005 | Pridmore, Jr. et al. | |
| 2006/0244612 | A1 | 11/2006 | Pridmore, Jr. et al. | |
| 2008/0220693 | A1 * | 9/2008 | Cuisinier | A63H 33/009 446/473 |
| 2009/0053678 | A1 | 2/2009 | Falkenhayn et al. | |
| 2010/0035709 | A1 | 2/2010 | Russell et al. | |
| 2011/0224025 | A1 | 9/2011 | Balardeta et al. | |
| 2012/0146770 | A1 | 6/2012 | Brannen et al. | |
| 2012/0256731 | A1 | 10/2012 | Luciano, Jr. et al. | |
| 2012/0270466 | A1 * | 10/2012 | McKee | A63H 17/006 446/175 |
| 2013/0176175 | A1 | 7/2013 | Zusman et al. | |
| 2013/0220160 | A1 | 8/2013 | Burdine et al. | |

OTHER PUBLICATIONS

Trovan(R) Electronic Identification System, "Trovan Micro Transponder Model—ID 200/300: Industrial Passive Transponder", 2 pages, Apr. 28, 1998.

Combined Search and Examination Report for GB Patent Application No. 1313809.4, Nov. 29, 2013.

* cited by examiner

TOY PROJECTILE LAUNCHING SYSTEM

CROSS REFERENCES TO RELATED APPLICATIONS

This application is a continuation of U.S. patent application Ser. No. 14/168,018, entitled TOY PROJECTILE LAUNCHING SYSTEM, and filed on Jan. 30, 2014 by inventor Benjamin Rosenberg. U.S. patent application Ser. No. 14/168,018 is a non-provisional of U.S. Provisional Application No. 61/896,071, entitled TOY PROJECTILE LAUNCHING SYSTEM, and filed on Oct. 27, 2012 by inventor Benjamin Rosenberg, the contents of which are hereby incorporated herein in their entirety.

U.S. patent application Ser. No. 14/168,018 claims benefit of GB Application No. 1313809.4 entitled A TOY PROJECTILE LAUNCHING SYSTEM, and filed on Aug. 1, 2013 by inventor Benjamin Rosenberg, the contents of which are hereby incorporated herein in their entirety.

FIELD OF THE INVENTION

This invention relates to a toy projectile launching system comprising a toy projectile launching apparatus and at least one toy projectile, wherein the toy projectile launching apparatus comprises a housing, a projectile launching mechanism and a projectile receptacle, wherein the toy projectile is adapted to be loaded into the projectile receptacle and launched by the projectile launching mechanism.

BACKGROUND

Currently there are many projectile launching games available, and they make use of a variety of projectiles. For example the projectiles may be darts, discs, balls or the like. The projectiles may be adapted to stick to a particular type of surface, for example using a sucker type apparatus, or one part of a hook-and-loop type fastening surface. Typically, the projectile launchers may be spring operated; operated using pressurised air generated by pumping action from the user; or a motorised roller assembly. The launchers may be adapted to hold a magazine of projectiles, so as to allow repeated firing by the user. In other examples, the launcher may be adapted to hold only one projectile, which in most cases is held in a ready to launch position.

The main manner of play involving the known projectile launching games has been to fire projectiles at a fellow user, preferably one who is also provided with a projectile launcher of their own so that they may retaliate. An alternative use has been to engage in a target practice type game, wherein the aim is to get the projectile to hit or pass through a target. In such a game, the user may compete against their own previous scores or against another user.

It can be seen that many of the known prior art games are purely mechanical devices, however, as technology advances, there have been moves to include electronic aspects in projectile launching games. For example, it is known to incorporate electronics into the projectile launching games to generate sound effects when firing a projectile to enhance the user experience.

It is therefore an object of at least some of the embodiments of the present invention to provide an improved toy projectile launching system.

BRIEF SUMMARY OF THE DISCLOSURE

According to the invention there is provided a toy projectile launching system comprising a toy projectile launching apparatus and at least one launchable toy projectile, wherein the toy projectile launching apparatus comprises a housing, a projectile launching mechanism and a projectile receptacle, wherein the toy projectile is adapted to be loaded into the projectile receptacle and launched by the projectile launching mechanism, characterized in that: the at least one toy projectile comprises an RFID tag; and the toy projectile launching apparatus further comprises an RFID writer adapted to write tag data to the RFID tag of the at least one toy projectile.

In this way, the toy projectile launching apparatus may write information to a projectile before launching it. That information may be used subsequently to provide additional functionality in the system, such as gaming functionality including hit recognition, launcher identification and so on.

In one embodiment of the invention, there is provided a system further comprising an RFID reader adapted to read RFID tags. Such an RFID reader may be incorporated into a separate target, such that the hit rate of the toy projectile launched at the target may be recorded. For instance, if two users were using the toy projectile launching system of the invention to launch toy projectiles at the same stationary target having an RFID reader, the RFID reader would be able to identify which toy projectiles had been fired by which toy projectile launching apparatus.

In another embodiment of the invention, there is provided a system in which the RFID reader and RFID writer form part of an RFID manager device. This is a particularly convenient way of providing the desired RFID functionality.

In a further embodiment of the invention, there is provided a system in which the RFID reader forms part of an external device adapted to dock with the toy projectile launching apparatus. Preferably, the external device is a mobile communications device. Many users will own their own smartphone, which may be equipped with RFID reader and writer functionality or may be programmable to have such functionality. It would therefore be more cost effective to provide the toy projectile launching apparatus adapted to work with an application installed on a user's smartphone or like device, instead of replicating the electronics required. The use of a mobile communications device in this way will allow for ease of use and added functionality. For example, the camera application, display screen, location tracking using GPS and communications services allowing in-game messaging could be combined to provide an augmented reality experience for the user.

In one embodiment of the invention, there is provided a system in which the toy projectile launching system further comprises a wireless communications module. In this way, communications between members of groups of toy projectile launching apparatuses and between toy projectile launching apparatuses and external devices may be permitted.

In a further embodiment of the invention, there is provided a system in which the projectile receptacle is a magazine for holding a plurality of toy projectiles.

In an alternative embodiment of the invention, there is provided a system in which the tag data comprises a launch timestamp. In this way, the time of launch of the toy projectile may be read by the RFID reader, for example when the toy projectile strikes the target area. Analysis of the time since launch may be useful in various game aspects associated with the system, for example, if too much time has passed since the launch, the toy projectile could be considered to have expired and a hit consequently invalid. In one embodiment of the invention, there is provided a system in which the tag data comprises an identifier associated with the toy projectile launching apparatus. In this way, the toy projectile launching apparatus that launched the toy projectile may be tracked.

In an embodiment of the invention, there is provided a system in which the tag data comprises a serial number. In this way, the toy projectile may be tracked. The serial number could be a unique serial number associated with that toy projectile; it could be unique within a sub-set of toy projectiles; the serial number may simply identify the place of manufacture or other processing of the RFID tag of the toy projectile, or the toy projectile itself.

In another embodiment of the invention, there is provided a system comprising at least a pair of toy projectile launching apparatuses, and at least one toy projectile comprising an RFID tag, wherein the at least one toy projectile is a launchable toy projectile for one toy projectile launching apparatus and an incoming toy projectile for a second toy projectile launching apparatus. In this way, two or more users may play together using the system, and a toy projectile launched from one toy projectile launching apparatus may strike the target area of another toy projectile launching apparatus and have that hit recorded by the communication between the RFID tag of the toy projectile and the RFID writer of the toy projectile launching apparatus.

According to the invention there is provided a toy projectile launching apparatus comprising a housing, a projectile launching mechanism and a projectile receptacle characterized in that: the toy projectile launching apparatus further comprises an RFID writer adapted to write data to an RFID tag.

In this way, the toy projectile launching apparatus may write information to the RFID tag of a toy projectile before launching it.

In one embodiment of the invention, there is provided an apparatus further comprising an RFID reader adapted to read RFID tags. In this way, the apparatus may read information, and record strikes, from inbound toy projectiles, such as those launched from another toy projectile launching apparatus.

In another embodiment of the invention there is provided an apparatus in which the RFID reader and RFID writer form part of an RFID manager device.

In a further embodiment of the invention there is provided an apparatus in which the RFID reader forms part of an external device adapted to dock with the toy projectile launching apparatus.

In an alternative embodiment of the invention there is provided an apparatus in which the external device is a mobile communications device.

In one embodiment of the invention there is provided an apparatus in which the toy projectile launching apparatus further comprises a wireless communications module. The wireless communications module may be incorporated into the control module or may be provided as part of the external device. The wireless communications module may be used to provide messaging between toy projectile launching apparatuses, or between a toy projectile launching apparatus and a computer providing software or firmware updates.

In another embodiment of the invention there is provided an apparatus in which the projectile receptacle is a magazine for holding a plurality of toy projectiles.

In a further embodiment of the invention there is provided an apparatus in which the RFID writer is adapted to write a timestamp to the RFID tag.

In an alternative embodiment of the invention there is provided an apparatus in which the RFID writer is adapted to write an identifier associated with the toy projectile launching apparatus to the RFID tag.

In one embodiment of the invention, there is provided a system in which the RFID writer is adapted to write a serial number to the RFID tag. The serial number may comprise any form of data that would allow the toy projectile launching apparatus to recognise the RFID tag as being part of a toy projectile.

According to the invention there is provided a toy projectile suitable for launch from a toy projectile launching apparatus, wherein the toy projectile comprises an RFID tag.

In this way, the toy projectile may have useful information written to it, which information may be useful for game play and retrieval.

In one embodiment of the invention there is provided a toy projectile in which the RFID tag is repeatedly writable. In this way, the toy projectile may be used over and over, with new information written each time.

In another embodiment of the invention there is provided a toy projectile in which the RFID tag is written with an identifier associated with a toy projectile launching apparatus. In this way, the tag identifies which particular toy projectile launching apparatus fired that toy projectile.

In a further embodiment of the invention there is provided a toy projectile in which the RFID tag is written with a timestamp of a time of launch. In this way, the time at which the toy projectile is launched is recorded on the toy projectile itself. Analysis of the time since launch may be useful in various games, for example, if too much time has passed since the launch, the toy projectile could be considered to have 'timed-out'.

In one embodiment of the invention, there is provided a toy projectile in which the RFID tag is written with a serial number. The serial number may be unique to the toy projectile; unique within a sub-set of toy projectiles, such as a set of 20 as sold; or may simply indicate a manufacturer or the like.

In an alternative embodiment of the invention there is provided a toy projectile in which the projectile is a dart having a tip and the RFID tag is located in or near the tip.

In one embodiment of the invention there is provided a toy projectile in which the projectile is a disc.

In another embodiment of the invention there is provided a toy projectile which is substantially spherical.

According to the invention there is provided a method of operating a toy projectile launching system comprising the steps of: loading the launchable toy projectile into the projectile receptacle; writing tag data to the RFID tag of the launchable toy projectile; and activating the projectile launching mechanism.

In this way, the toy projectile launching apparatus fires a projectile that is now more than a simple projectile but is in fact a projectile carrying information relevant to its launch.

In one embodiment of the invention there is provided a method in which the toy projectile launching apparatus further comprises an RFID reader in a target area. This is particularly useful in a game play situation, as RFID tags on inbound toy projectiles may be read so as to record their striking the target area and the method comprises receiving a strike at the target area from an incoming toy projectile; and reading tag data from the RFID tag of the incoming toy projectile.

In another embodiment of the invention there is provided a method in which the system comprises at least a first toy projectile launching apparatus and a second toy projectile launching apparatus, each having at least one toy projectile comprising an RFID tag and the method comprises the steps of: loading a first toy projectile into the projectile receptacle of the first toy projectile launching apparatus, activating the projectile launching mechanism of the first toy projectile launching apparatus; the first toy projectile impacting the target area of the second toy projectile launching apparatus;

the RFID reader of the second toy projectile launching apparatus reading the tag data on the first toy projectile.

In this way, two or more players may play against each other where each user's hits against the other are recorded.

In a further embodiment of the invention there is provided a method in which each toy projectile launching apparatus comprises a display device, and the method comprises the additional step of the display device of the second toy projectile launching apparatus displaying a message based on the tag data read from the first toy projectile. Furthermore, where a wireless communications module is provided, for example as part of an inbuilt control module or a docked smartphone, the message could also be relayed back to the first toy projectile launching apparatus, thus making the shooter aware of their successful strike.

According to the disclosure, there is provided a toy projectile launching system comprising a toy projectile launching apparatus and at least one incoming toy projectile, wherein the toy projectile launching apparatus comprises a housing, a projectile launching mechanism and a projectile receptacle, characterized in that: the at least one incoming toy projectile comprises an RFID tag having tag data written thereto; and the toy projectile launching apparatus further comprises an RFID reader adapted to read tag data from an RFID tag, the RFID reader being located in a target area.

In this way, the toy projectile launching apparatus is provided with automatic strike recognition. The toy projectile launching apparatus can tell when it has been struck by an incoming toy projectile by reading the tag data from the incoming projectile.

In one aspect of the disclosure, there is provided a system further comprising at least one launchable toy projectile adapted to be loaded into the projectile receptacle and launched by the projectile launching mechanism; and an RFID writer adapted to write tag data to the RFID tag of the at least one launchable toy projectile. In this way data may be written to the RFID tag contemporaneously with launch. A launchable projectile becomes an incoming projectile once launched.

According to the disclosure there is provided a toy projectile launching apparatus comprising a housing, a projectile launching mechanism and a projectile receptacle characterized in that: the toy projectile launching apparatus further comprises an RFID reader adapted to read tag data from an RFID tag, the RFID reader being located in a target area.

In this way, the toy projectile launching apparatus may detect strikes or hits by inbound toy projectiles having RFID tags.

In one aspect of the disclosure, there is provided a system further comprising an RFID writer adapted to write data to an RFID tag. In this way, the toy projectile launching apparatus may write information to a toy projectile before launching it.

According to the disclosure there is provided a method of operating a toy projectile launching system, comprising the steps of: receiving a strike at the target area from an incoming toy projectile; and reading tag data from the RFID tag of the incoming toy projectile.

In this way, the strike from an incoming toy projectile may be recognised by the struck toy projectile launching apparatus. This allows users to be more aware of successful hits against them and may also allow users to monitor their strike rate against others.

In one aspect of the disclosure, there is provided a system further comprising an RFID writer adapted to write data to an RFID tag of a launchable toy projectile, the method comprises the additional steps of: loading the launchable toy projectile into the projectile receptacle; writing tag data to the RFID tag of the launchable toy projectile; activating the projectile launching mechanism. In this way, while acting as a target for another user launching projectiles at him, a user may return fire with RFID tagged toy projectiles such that their strike rate on the competitor toy projectile launching apparatus may also be recorded. In such a method, it will be understood that the order of steps may vary such that actions relating to incoming toy projectiles may be intermixed with actions relating to launchable toy projectiles.

BRIEF DESCRIPTION OF THE DRAWINGS

Embodiments of the invention are further described hereinafter with reference to the accompanying drawings, in which:

FIG. 7(*b*) is an exploded view of the toy projectile of FIG. 7(*a*);

FIG. 8(*b*) is an exploded view of the toy projectile of FIG. 8(*a*);

FIG. 9(*b*) is an exploded view of the toy projectile of FIG. 9(*a*).

DETAILED DESCRIPTION

Figure 1:
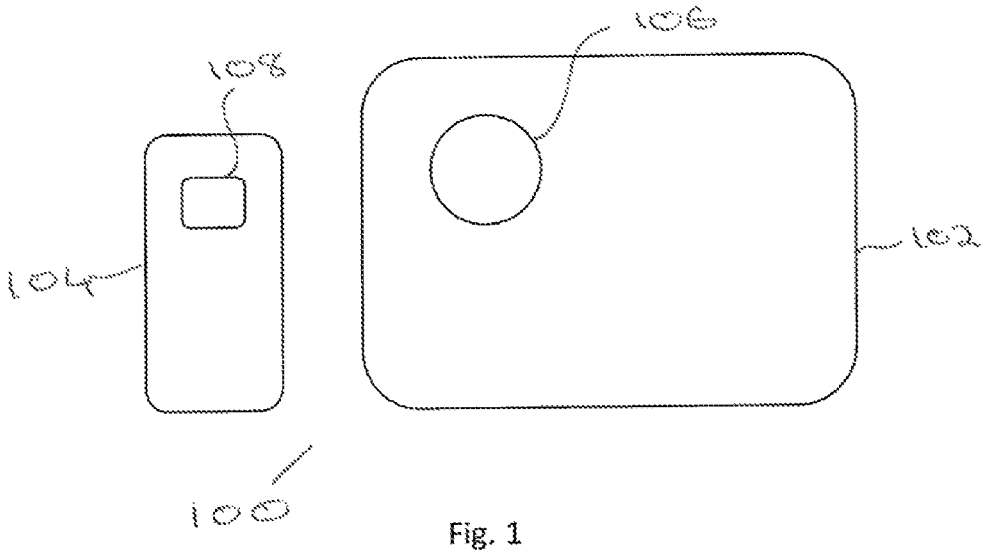
FIG. 1 is a block diagram of a toy projectile launching system according to an embodiment of the invention.

Referring initially to FIG. 1, there is shown a block diagram of a first embodiment of a toy projectile launching system, indicated generally by the reference numeral 100. The toy projectile launching system 100 comprises a toy projectile launching apparatus 102 and a toy projectile 104. The toy projectile launching apparatus 102 comprises an RFID reader 106 adapted to read tag data from an RFID tag 108 of the toy projectile 104. In this instance, the toy projectile may be described as an incoming toy projectile as it is fired at the toy projectile launching apparatus 102, not launched by it.

Figure 2:
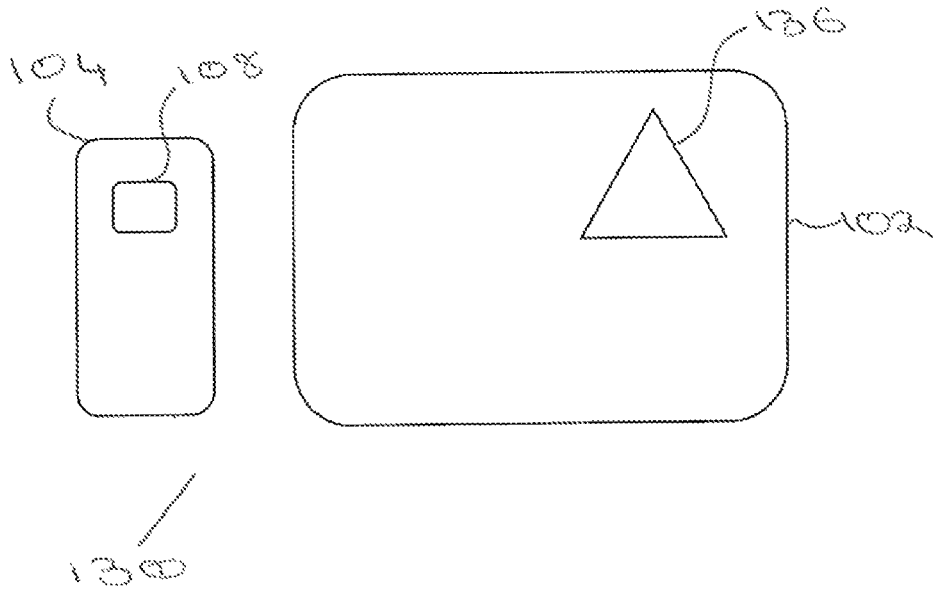
FIG. 2 is a block diagram of a toy projectile launching system according to an alternative embodiment of the invention.

Referring to FIG. 2, there is shown a block diagram of an alternative embodiment of a toy projectile launching system, indicated generally by the reference numeral 130. The toy projectile launching system 130 again comprises a toy projectile launching apparatus 102 and a toy projectile 104, however, the toy projectile launching apparatus 102 comprises an RFID writer 136 adapted to write tag data to an RFID tag 108 of the toy projectile 104. In this instance, the toy projectile may be described as a launchable toy projectile as it is intended to be launched by the toy projectile launching apparatus 102 at an external target.

Figure 3:
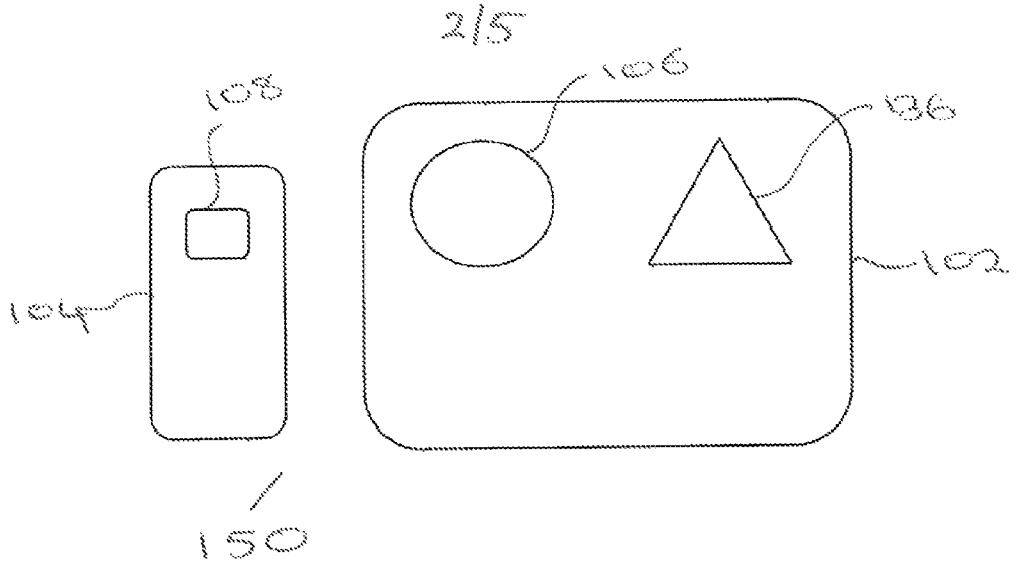
FIG. 3 is a block diagram of a toy projectile launching system according to a further embodiment of the invention.

Referring to FIG. 3, there is shown a block diagram of a further embodiment of a toy projectile launching system, indicated generally by the reference numeral 150. The toy projectile launching system 150 comprises a toy projectile launching apparatus 102 and a toy projectile 104. The toy projectile launching apparatus 102 comprises an RFID writer 136 adapted to write tag data to an RFID tag 108 of a launchable toy projectile 104 and an RFID reader 106 adapted to read tag data from an RFID tag 108 of an incoming toy projectile 104. It will be understood that incoming toy projectiles and launchable toy projectiles are essentially physically the same, and are defined in relation to a particular toy projectile launching apparatus. A toy projectile that is loaded and fired by a first projectile launching apparatus is a launchable toy projectile for that projectile launching apparatus, but an incoming toy projectile for a projectile launching apparatus it may be fired at.

Figure 4:
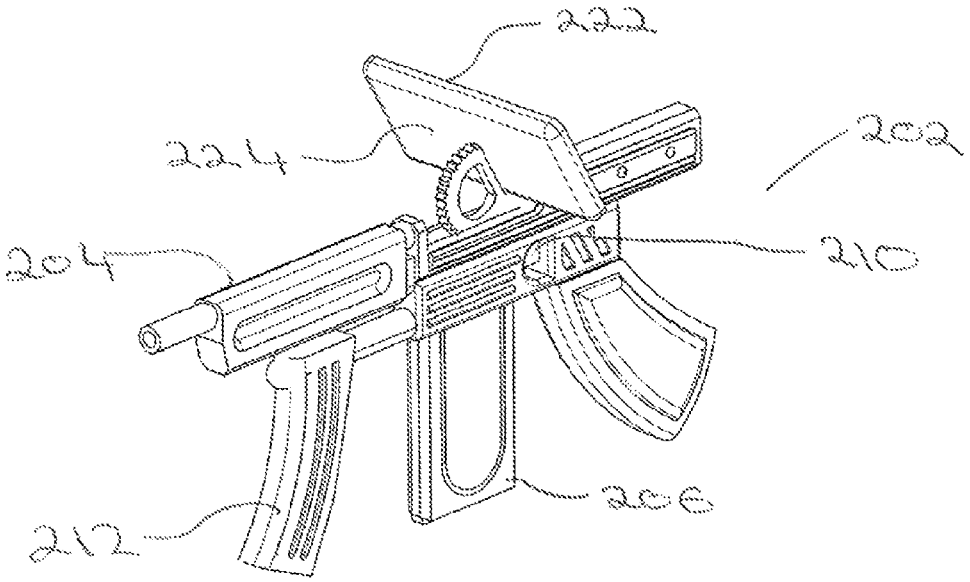
FIG. 4 is a front perspective view of a toy projectile launching apparatus according to an embodiment of the invention.
Figure 5:
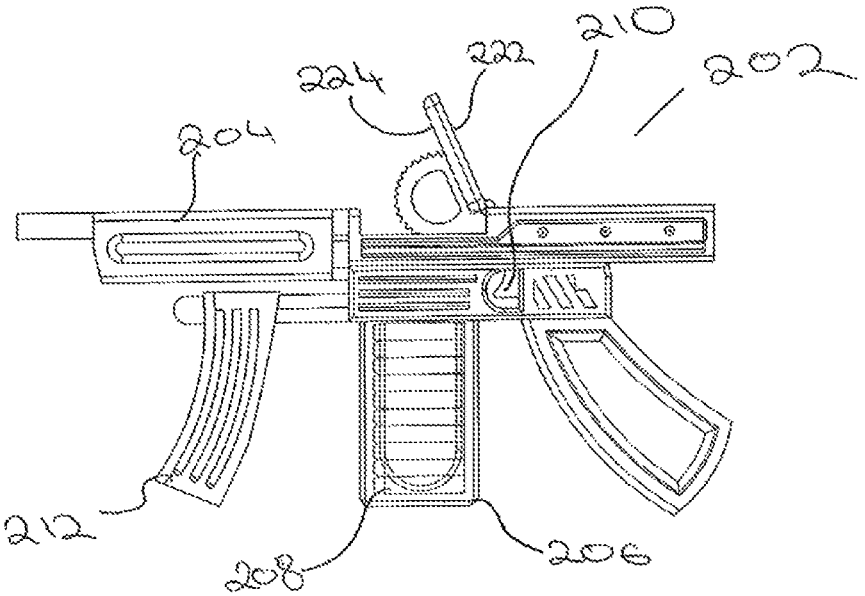
FIG. 5 is a side view of a toy projectile launching apparatus according to an embodiment of the invention wherein the toy projectile launching system comprises a RFID manager device and the RFID manager device is in a working position.
Figure 6:
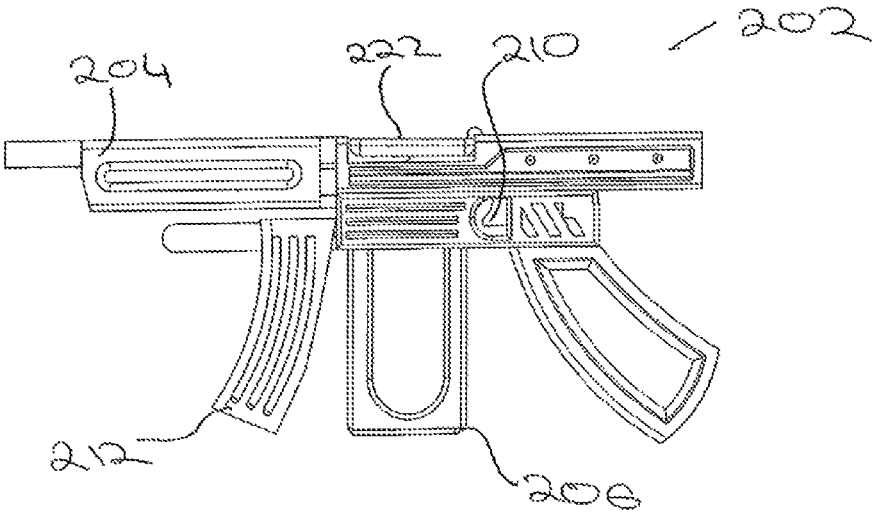
FIG. 6 is a side view of the toy projectile launching apparatus of FIG. 5 wherein the RFID manager device is in a non-working position.

Referring now to FIGS. 4-6, there is shown a particular embodiment of toy projectile launching apparatus 202 comprising a housing 204 which is substantially in the shape of an automatic weapon and a projectile receptacle, in this case a magazine 206. The magazine 206 is holding a plurality of toy projectiles, in this case darts 208. The toy projectile launching apparatus 202 further comprises a projectile launching mechanism (not shown) contained substantially within the housing 204. The projectile launching mechanism includes a trigger 210 and a manual advancement handle 212.

The toy projectile launching apparatus 202 further comprises a control module which in turn comprises an RFID writer (not shown), an RFID reader (not shown), a display screen 222 and wireless communications module (not shown). The control module is pivotably mounted on the top of the housing 204 of the toy projectile launching apparatus 202. The control module is pivotable between an upright working position, shown in FIG. 5, and a non-working position, largely flush with the top horizontal surface of the toy projectile launching apparatus 202, as shown in FIG. 6.

In the upright working position, the display screen 222 faces towards the stock of the toy projectile launching apparatus 202 and the opposing face 224 of the control module faces towards the front of the launching apparatus. Preferably, the RFID reader will be located adjacent this opposing face 224, such that items comprising RFID tags touching the opposing face 224 will have their tags read when the items make contact with the opposing face 224. In this way, the opposing face 224 of the control module 220 acts as a target area in game play involving a pair of toy projectile launching apparatuses 202.

In the non-working position, the control module 220 is folded down flat into a recess in the housing, such that the display screen 222 is substantially flush with the top surface of the housing 204 and the opposing face 224 faces down into the housing. This position may be used when the toy projectile launching apparatus 202 is not in use, or as a 'defence' position in a game. The 'defense' position may be used, for example, when the player is reloading their toy projectile launching apparatus 202. The 'defense position' hides at least a portion of the target area, and renders access to the remaining target face difficult for incoming projectiles.

It will be understood by the person skilled in the art that a typical smartphone may comprise all the features of the control module. As such, in another embodiment (not shown), the toy projectile launching apparatus does not include an integral control module, but the housing comprises a docking station for reception of a user's smartphone. In such an embodiment, the smartphone would comprise software that when executed would provide the functionality of the control module such as RFID functionality and messaging between toy projectile launching apparatuses 102. The docking station for such an external device may allow the external device to pivot between working and not-working positions, similarly to the control module described in relation to FIGS. 4-6.

It will be understood by the person skilled in the art that the shape and configuration of the toy projectile launching apparatus 102 shown in FIGS. 4-6 are by way of example only and may vary within the scope of the claimed invention. For example, the toy projectile launching apparatus may include automatic reloading instead of manual and may be equipped with any suitable projectile launching arrangement and any suitable projectile receptacle. Furthermore, the location of the RFID reader and accompanying target area may be different in other exemplary designs, either when included on their own; as part of an integral control module; or as part of a docked external control module, such as a smartphone.

Figures 7A, 7B:
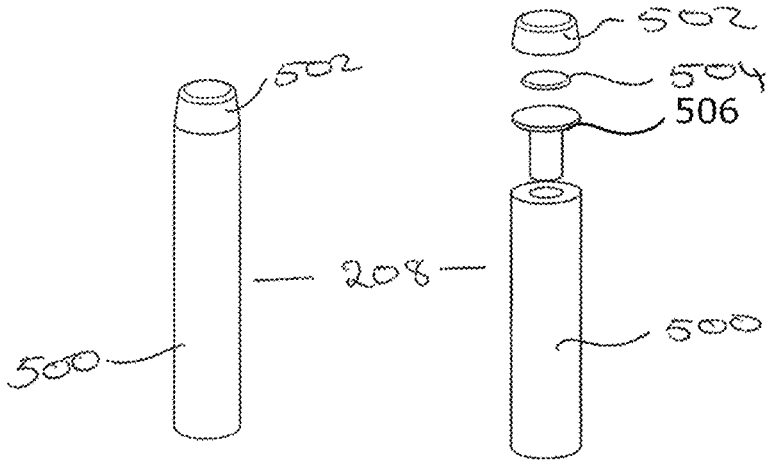
FIG. 7(*a*) is a first embodiment of toy projectile for use in the invention.

Referring now to FIGS. 7(*a*) and (*b*) there is shown an embodiment of a toy projectile in the form of a dart 208, suitable for use with the toy projectile launching apparatus 202 shown in FIGS. 4-6. The dart 208 comprises an elongate cylindrical dart body 500 with a slightly tapered dart tip 502 at one end thereof. The dart tip 502 is partially hollow and has an RFID tag 504 fitted therein. The RFID tag 504 is closed within the dart tip 502 by a cover 506 having a flat cylindrical cap with a post projecting rearwardly therefrom. The post extends into a suitable aperture in the top of the dart body 500. Typically, the dart body is made from a resilient foam, while the dart tip is made from a harder plastic. It will be understood by the person skilled in the art that a variety of potential structures for a dart comprising an RFID tag are possible and that the invention is not limited to the structure described here in relation to FIGS. 7(*a*) and (*b*). For example, the RFID tag may be located in the body of the dart, close to the tip or right at the tip thereof. The RFID tag may be molded in place or otherwise secured in place in a number of ways.

Figures 8A, 8B:
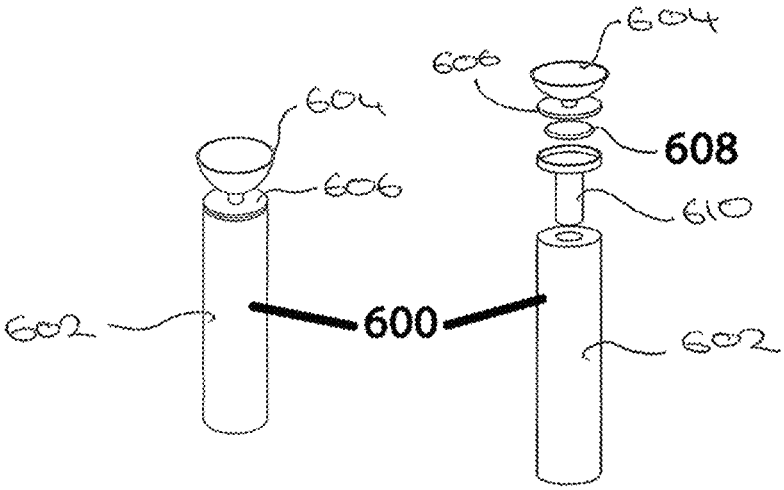
FIG. 8(*a*) is an alternative embodiment of toy projectile for use in the invention.

Referring now to FIGS. 8(*a*) and (*b*) there is shown a further embodiment of a toy projectile in the form of a suction cup dart 600, suitable for use with the toy projectile launching apparatus 202 shown in FIGS. 4-6. The suction cup dart 600 comprises an elongate cylindrical dart body 602 with a suction cup 604 at one end thereof. The suction cup 604 has a diameter similar to that of the dart body 602. The suction cup 604 extends from a flat cylindrical cover 606. An RFID tag 608 is fitted between the cover 606 and a lipped cap 610 with a post projecting rearwardly therefrom. The RFID tag 608 is closed between the cover 606 and the lipped cap, such that it sits within the lip of the cap. The post extends into a suitable aperture in the top of the dart body 500. Typically, the dart body is made from a resilient foam, while the dart tip is made from a harder plastic. It will be understood by the person skilled in the art that the materials used in the darts as described may vary as long as the materials do not unduly hinder the RFID communications.

Figure 9A:
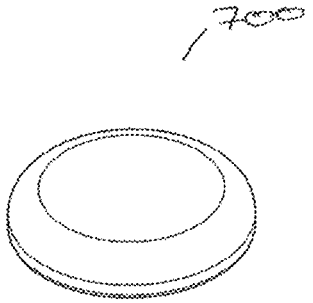
FIG. 9(*a*) is a further embodiment of toy projectile for use in the invention.
Figure 9B:
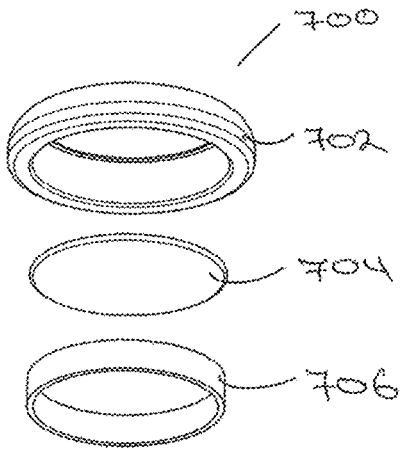

Referring now to FIGS. 9(*a*) and (*b*) there is shown a further embodiment of a toy projectile in the form of a disc 700. The disc 700 comprises a disc body 702, and RFID tag 704, and a support ring 706. The disc body 702 is closed on the top and the RFID tag 704 sits under the top surface thereof. The RFID tag 704 is held in place by the support ring 706. It will be understood that there are many constructions of a disc that would be suitable for use as a projectile within the scope of the invention.

It will be understood by the person skilled in the art that such a disc would not be launched by the toy projectile launching apparatus 202 shown in FIGS. 4-6, however suitable launchers are currently available that could launch such a disc, for example certain launchers provided by NERF®.

The toy projectile launching apparatus 202 shown in FIGS. 4-6 and the darts of FIGS. 7(*a*) and (*b*) combine to form an embodiment of a toy projectile launching system. In a first exemplary use of such a system, a user may operate the toy projectile launching system in a target practice mode, wherein the system further comprises a target (not shown) having an RFID reader, a processor to process data read by the RFID reader and a display. The user loads one or more darts 208 into the magazine 206 of the toy projectile launching apparatus 202. The RFID tags 504 of the darts 208 may be blank or may comprise previously written data. The user prepares to shoot the first dart 504 by using the manual advancement handle 212, which loads a dart 208 into the chamber. The user then aims and shoots the dart 208 by pulling the trigger 210. The action of pulling the trigger causes the RFID writer to write data to the RFID tag 504 of the dart 208 in the chamber before the dart is fired. This data writing process is very fast and the delay caused is not noticeable to the user. The data includes a timestamp for the time of firing. If the dart 208 has been well aimed and fired, it should make contact with the target. When it makes contact, the RFID reader in the target will read the data on the RFID tag 504. The processor can then control the display to indicate that the dart 208 hit the target. The processor will check the time of the timestamp on the dart 208 to ensure that it hit the target within a reasonable time of being fired. In this way, cheating may be eliminated, by ensuring that darts that missed the target are not picked up later and touched off the target.

The user can keep launching darts until their magazine is empty. The data written to the dart may also include an identifier for the toy projectile launching apparatus 202. In this way, it is possible to find out which toy projectile launching apparatus 202 shot the dart. This is useful if multiple users are shooting their own personal darts at their own target but in a shared area, where darts may get mixed up after firing. Similarly, if multiple users were firing at a single target, it would be necessary for the target to be able to identify the toy projectile launching apparatus 202 that launched the projectile.

In another exemplary method of use, there is no data written to the RFID by the toy projectile launching apparatus, and the toy projectile may comprise RFID tag data written earlier, for example at manufacturing. Obviously, such tags will still provide a strike recognition function if they hit an RFID enabled target. Such an RFID enabled target may be located in a competitor's toy projectile launching apparatus.

It will be understood by the person skilled in the art that, when the toy projectile launching apparatus is writing RFID tag data to the RFID tag in the toy projectile, the timing of writing that tag data and the trigger action for writing that tag data may be adjusted as best suit the physical apparatus used. In some cases, it may be useful for the magazine to comprise some shielding such that the act of writing tag data to the RFID tag of an imminently launchable toy projectile does not affect the rest of the toy projectiles.

In another method of use similar to above, multiple users, each with a toy projectile launching apparatus 202 are firing at the same target. In this embodiment, the data written to the RFID tags 504 includes an identifier for the toy projectile launching apparatus 202. Then when a dart 208 strikes the target, the identifier and timestamp are read. The processor may then keep count of, and display, the number of hits for each user.

A pair of toy projectile launching apparatuses 202, each having a set of darts 208, forms another embodiment of toy projectile launching system. In such a system, each user aims to fire their darts such that they make contact with the opposing face of the control module of their opponent's toy projectile launching apparatus 202. When the control module records a hit, it may display a suitable message on the display screen. Other actions may be programmed to further enhance game play, for example, emitting a noise when hit. On identification of the toy projectile launching apparatus 202 that fired the successful projectile, the communications module of the struck toy projectile launching apparatus 202 may transmit a message to the firing toy projectile launching apparatus 202 to alert them that they made a hit.

If there is data written on the RFID tags of the darts when they are in the chamber, it will be overwritten by the RFID writer, such that darts 208 may be used repeatedly.

It will be understood that it is not necessary for the tag data to include a timestamp.

The data and programs stored on the control module may be updated by way of the communications module, which may comprise Wi-Fi, Bluetooth, cellular communications or other suitable communications.

As discussed, the control module may take the form of the user's smartphone docked with the housing. In such a situation, the user downloads a suitable application, referred to as an app, to their device. The app provides the required RF functionality, and other features, such as in-game messaging and additional game-play features. For example, a user may be able to program a certain number of darts to be more damaging than others. In this way, the data written to the RFID tag would include a 'damage level' field. A user may be given a certain value of damage that he may distribute across their darts as they see fit. Typically a smartphone includes a touch screen or other form of user input device.

The app may be able to introduce an element of augmented reality into the game-play. This augmented reality could include the use of the camera functionality of the smartphone, for example to provide crosshairs; GPS tracking of one or more opponents' locations; and ammunition with variable virtual attributes. This use of ammunition with variable virtual attributes would allow a user to upgrade their ammunition, for example through an in-app purchase or as a result of a game reward, say for a high score. As mentioned above, such ammunition would result in a higher level of damage, for example significantly reducing an opponent's health rating, if it made contact with its target. Similarly, projectiles could be classified as different types of ammunition, for example bombs, grenades or mines.

The communications range for the RFID tags, RFID readers and RFID writers may be chosen to facilitate the best method of operation, such as to facilitate writing data to RFID tags in a convenient manner, and reading data at a suitable distance.

The person skilled in the art will understand that further embodiments of toy projectile launching system are possible, for example using the launcher of FIGS. 4-6 and the suction cup dart 600 having a suction cup. The advantage of the suction cup is that if the suction cup dart 600 is well fired, it will stick to its receiving surface. If the receiving surface comprises an RFID reader, there will be ample time to read data from the stuck suction cup dart 600.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A toy projectile launching system comprising:

at least one toy projectile; and at least one toy launcher, each comprising:

a receptacle into which a projectile is loaded;

a launching mechanism for physically launching a projectile after it is loaded into said receptacle;

a target area sensitive to being hit by a projectile;

a display for presenting a message when a projectile, launched by another launcher, hits said target area; and a wireless communications module, operable to transmit a message to the other launcher that launched the projectile, when that projectile hits said target area.

2. The system of claim 1, wherein each projectile comprises an RFID tag, the system further comprising at least one RFID reader, operative to read the RFID tag of the projectile that hits said target area of a launcher.

3. The system of claim 2, wherein the message presented by said display is based on the RFID tag of the projectile that hits said target area of the launcher.

4. The system of claim 1, wherein each launcher comprises a dock for a smartphone, and wherein said wireless communications module comprises a smartphone that is docked in the launcher.

5. The system of claim 4, wherein said display comprises a screen on the smartphone that is docked in the launcher.

6. The system of claim 1, wherein said target area is located on the opposite face of said display.

7. A method for operating a toy projectile launching system comprising:

identifying a hit by a toy projectile on a target area of a toy launcher, the toy projectile having an RFID tag embedded therein;

reading the RFID tag when the projectile hits the target area of the launcher;

displaying a message, based on the RFID tag, subsequent to said reading; and wirelessly transmitting a message to the launcher that launched the projectile, subsequent to said reading.

8. The method of claim 7 wherein said wirelessly transmitting is performed via a smartphone that is docked in the launcher that is hit by the projectile.

* * * * *